US005878543A

United States Patent [19]

Mowery

[11] Patent Number: 5,878,543

[45] Date of Patent: Mar. 9, 1999

[54] INTERLOCKING SIDING PANEL

[75] Inventor: Jack T. Mowery, Medina, Ohio

[73] Assignee: Associated Materials, Incorporated, Akron, Ohio

[21] Appl. No.: 40,011

[22] Filed: Mar. 17, 1998

[51] Int. Cl.[6] ..... E04C 2/38

[52] U.S. Cl. ..... 52/519; 52/520; 52/529; 52/539; 52/543; 52/555; 52/558

[58] Field of Search ..... 52/519, 520, 529, 52/539, 543, 555, 558

[56] References Cited

U.S. PATENT DOCUMENTS

| | | | |
|---|---|---|---|
| 453,743 | 6/1891 | Heller et al. . | |
| 2,897,930 | 8/1959 | Primick . | |
| 3,363,380 | 1/1968 | Merrill . | |
| 4,104,841 | 8/1978 | Naz . | |
| 4,308,702 | 1/1982 | Rajewski | 52/519 |
| 4,450,665 | 5/1984 | Katz . | |
| 5,388,381 | 2/1995 | Billinski et al. . | |

*Primary Examiner*—Christopher Kent
*Attorney, Agent, or Firm*—Banner & Witcoff, Ltd.

[57] ABSTRACT

Siding panel for installation on the walls, soffits or other exposed surfaces of a structure having a nailing hem folded back upon itself to form a lateral edge of the siding panel and terminating in a first lip projecting outwardly from the front side of the siding panel and away from the lateral edge. A U-shaped channel is formed on the front side of the siding panel and is connected to the nailing hem. A U-shaped projection extends along the siding panel and terminates in a second lip projecting away from the back of the siding panel and the U-shaped projection. The U-shaped channel receives a U-shaped projection of an adjacent panel and the first lip engages and interlocks with the second lip of the adjacent panel.

27 Claims, 5 Drawing Sheets

INTERLOCKING SIDING PANEL

INTRODUCTION

The present invention is directed to siding panels, and, more particularly, to siding panels having improved interlocking engagement with adjacent panels.

BACKGROUND

Siding, or wall siding, is commonly used to cover the exterior surfaces, e.g. walls and soffits, of structures. Such siding is often formed of metal such as aluminum or thermoplastic materials, such as polyvinyl chloride (PVC). Siding installed on vertical surfaces may be formed with declinations, that is, downwardly and outwardly extending flat portions, which combine with horizontal shoulders to form a clapboard profile. Siding for soffits and other surfaces may be formed with recessed longitudinal channels.

Such siding is typically installed in multiple rows of panels, each row overlapping panels to which it is adjacent. Adjoining panels are overlapped in this manner to provide protection for the structure from the elements. The overlapping edges of a panel may separate from the overlapped panel, forming potentially problematic gaps between adjacent panels. These gaps can allow wind to get behind the panels and possibly lead to panels being blown off the structure.

It is an object of the present invention to provide improved wall siding which reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY OF THE INVENTION

The principles of the invention may be used to advantage to provide a siding panel having lips, a projection and a channel to provide an interlocking engagement with an adjacent panel.

In accordance with a first aspect, each panel comprises a nailing hem folded back upon itself, forming a lateral edge of the panel and terminating in a first lip projecting outwardly from a front side of the panel and away from the lateral edge. A substantially U-shaped channel on a front side of the panel is connected to the nailing hem, having a mouth facing the lateral edge. A substantially U-shaped projection extends along the panel, the U-shaped projection being adapted to be received by a U-shaped channel of an adjacent panel. A second lip is connected to the U-shaped projection and projects away from a back side of the panel and the U-shaped projection. The second lip is adapted to engage and interlock with a first lip of an adjacent panel.

In accordance with another aspect, a siding panel has a nailing hem adjacent a lateral edge of the panel and terminates in a first lip projecting outwardly from a front side of the panel and away from the lateral edge. A substantially U-shaped channel on a front side of the panel is connected to the nailing hem, having a mouth facing the lateral edge. A substantially U-shaped projection extends along the panel, the U-shaped projection being adapted to be received by a U-shaped channel of an adjacent panel. A second lip is connected to the U-shaped projection and projects away from a back side of the panel and the U-shaped projection. The second lip is adapted to engage and interlock with a first lip of an adjacent panel.

In accordance with yet another aspect, a siding panel has a nailing hem adjacent a lateral edge of the panel and terminates in a first lip projecting outwardly from a front side of the panel and away from the lateral edge. A substantially U-shaped channel on a front side of the panel is connected to the nailing hem, having a mouth facing the lateral edge. A substantially U-shaped projection extends along the panel, the U-shaped projection being adapted to be received by a U-shaped channel of an adjacent panel. A second lip is connected to the U-shaped projection and projects away from a back side of the panel and the U-shaped projection. The second lip is adapted to engage a first lip of an adjacent panel to substantially prevent the separation of the adjacent panels from one another.

From the foregoing disclosure, it will be readily apparent to those skilled in the art that the present invention provides a significant technological advance. Substantial advantage is achieved by providing such siding panels. In particular, a secure, positive engagement between adjacent panels is achieved. This is highly advantageous as it improves the wind load tolerance and structural integrity of the siding. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
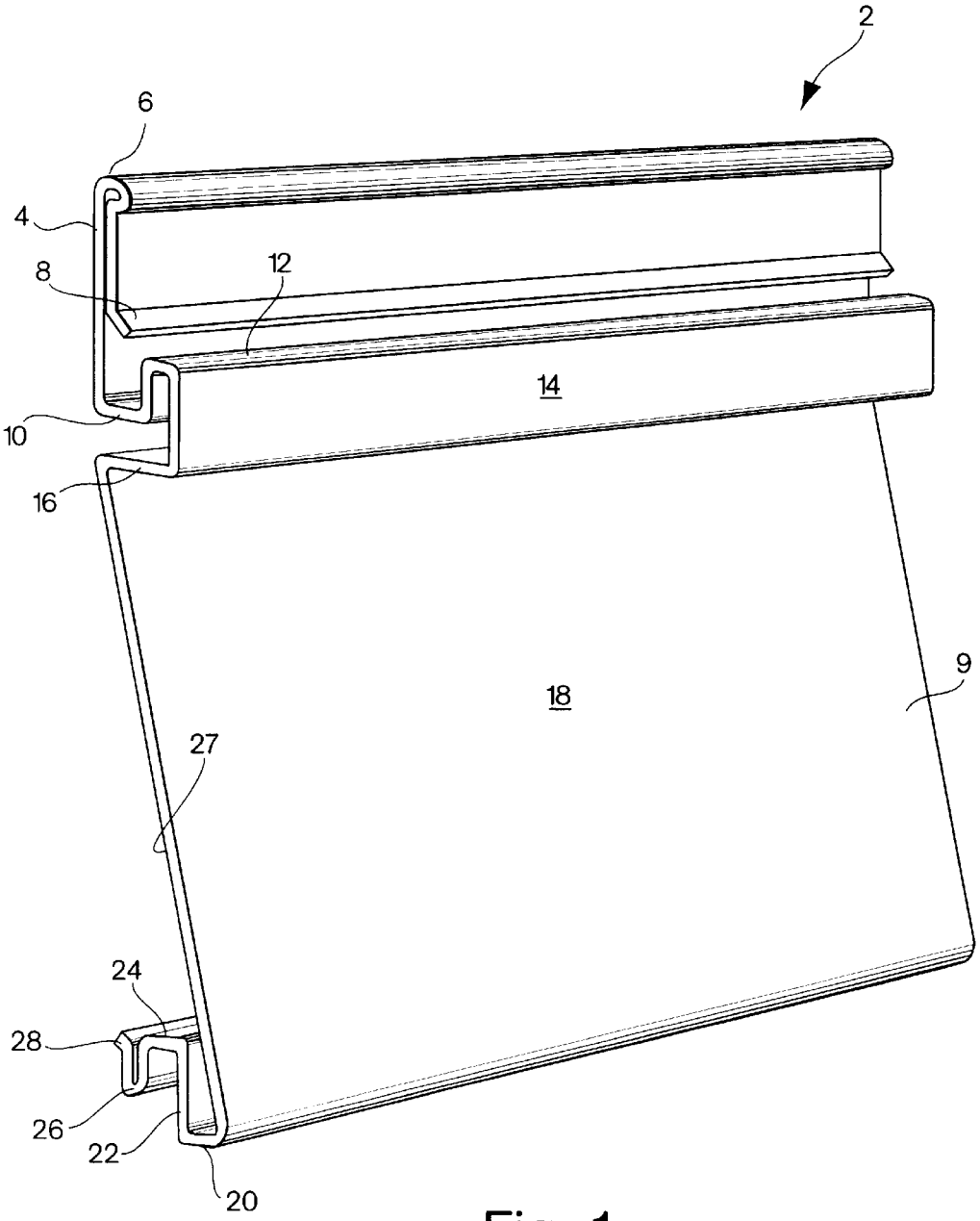
FIG. 1 is a schematic perspective view of a siding panel according to one preferred embodiment of the present invention.

The figures referred to above are not drawn to scale and should be understood to present a simplified representation of the invention, illustrative of the basic principles involved. Some features of the siding panel depicted in the drawings have been enlarged or distorted relative to others to facilitate explanation and understanding. The same reference numbers are used in the drawings for similar or identical components and features shown in various alternative embodiments. The siding panel, as disclosed here, will have configurations and components determined, in part, by the intended application and environment in which it is used.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume wall siding attached to surfaces, e.g. walls and/or soffits, of a structure such as a house. These directional references are given in reference to the surface plane, such as the ground, upon with the structure sits, and the plane of the wall of the structure itself. Horizontal, therefore, refers to a direction which is substantially parallel to the surface plane and substantially perpendicular to the wall of the structure. Vertical refers to a direction which is substantially parallel to the wall of the structure and substantially perpendicular to the surface plane. Outwardly refers to a direction moving substantially away from the wall or surface of the structure upon which the siding is attached while inwardly refers to a direction moving substantially toward the wall or surface of the structure. Downwardly refers to a direction moving substantially vertically toward the surface plane and upwardly refers to a direction moving substantially vertically away from the surface plane. Lower and upper refer to vertical directions with lower being closer to the surface plane than upper. Left and right are in reference to directions given when one is looking at the structure.

A first preferred embodiment of a siding panel or panel, designated generally by the reference numeral 2, is shown in FIG. 1. Panel 2 comprises a nailing hem 4, folded back upon itself to form a lateral edge 6. The term nailing hem, when used herein, refers to a portion of the panel which is substantially planar and typically extends along a lateral edge of the panel. In embodiments of the panel installed in a vertical fashion on substantially vertical surfaces, the nailing hem typically extends along an upper edge of the panel. Nailing hem 4 terminates in a first lip 8 which projects outwardly from a front side 9 of panel 2 and away from lateral edge 6. A substantially U-shaped channel 10 is formed along panel 2. A first leg of channel 10 is connected to nailing hem 4 and a second leg of channel 10 is connected to a first shoulder 12. A mouth of channel 10 opens toward lateral edge 6. A first shoulder 12 connects channel 10 to an upper edge of an upper planar member 14. Upper planar member 14 preferably extends in a substantially vertical plane. A second shoulder 16 connects a lower edge of upper planar member 14 to an upper edge of a declination 18. The term declination, when used here, refers to a substantially planar portion of the panel 2 which slopes downwardly and slightly outwardly from an upper edge. A third shoulder 20 connects a lower edge of declination 18 to a lower edge of a lower planar member 22. Lower planar member 22 preferably extends in a substantially vertical plane. Fourth shoulder 24 connects an upper edge of lower planar member 22 to a downwardly projecting substantially U-shaped projection 26. Projection 26 terminates in a second lip 28 which projects inwardly from a rear side 27 of panel 2 and away from U-shaped projection 26. In a preferred embodiment, first shoulder 12, second shoulder 16, third shoulder 20, and fourth shoulder 24 extend substantially horizontally.

Figure 2:
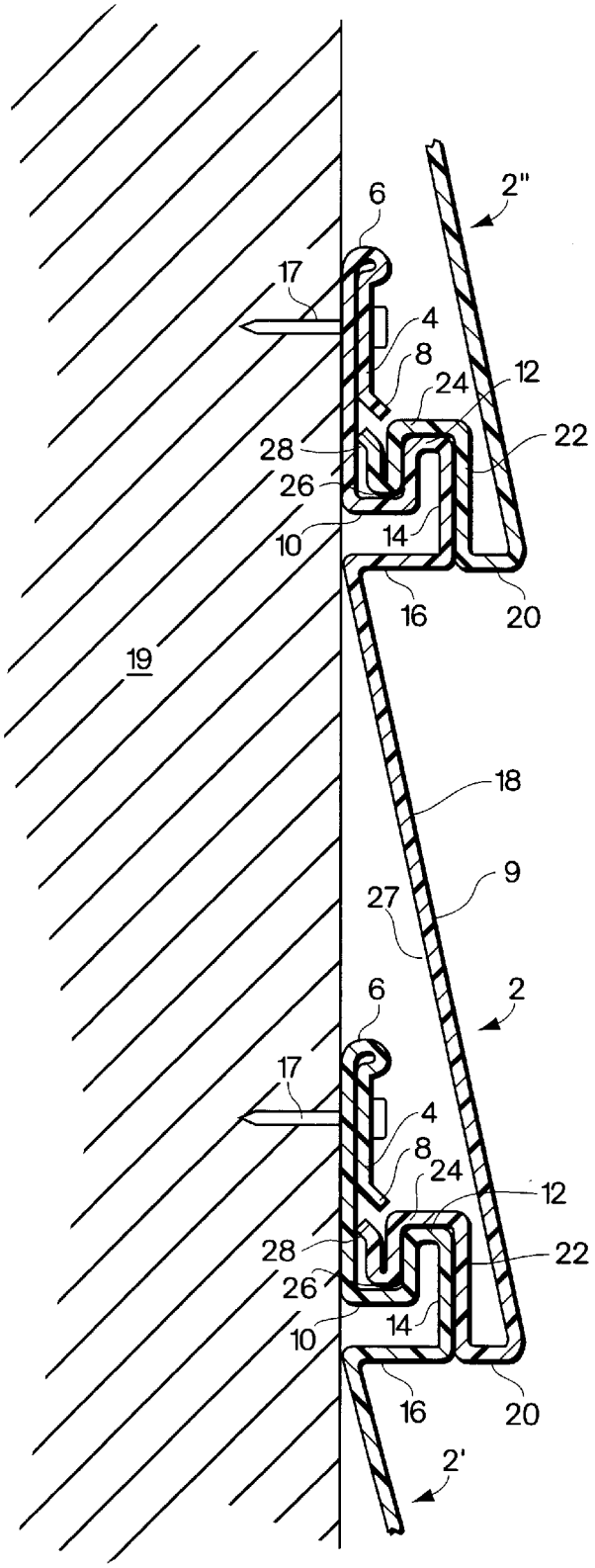
FIG. 2 is a schematic section view, shown partially cut away, of three vertically adjacent, overlapping, and interlocking siding panels of the present invention.

The vertical overlapping manner in which adjacent panels are installed is shown in FIG. 2. A first panel 2' (shown partially cut away as the lowermost panel) is fastened to structure 19 via nails 17 or other suitable fasteners which are driven through nailing hem 4. A second panel 2 is installed directly above the first panel 2 by sliding U-shaped projection 26 of panel 2 into U-shaped channel 10 of first panel 2'. As second panel 2 is moved into engagement with first panel 2', second lip 28 of second panel 2 and first lip 8 of first panel 2' resiliently engage one another, flexing toward their respective panels until second lip 28 passes first lip 8, at which point each lip returns to its original orientation. In this position, U-shaped projection 26 of panel 2 is received by U-shaped channel 10 of panel 2', with second lip 28 being positioned behind and below first lip 8, whereby panels 2, 2' are captured in an engaging and interlocking relationship. In this manner, second lip 28 interlocks with and engages first lip 8 such that second panel 2 is positively engaged with first panel 2'. When first panel 2' and second panel 2 are so installed, second shoulder 16 of first panel 2' and third shoulder 20 of second panel 2 are substantially coplanar. In a preferred embodiment, both second shoulder 16 of first panel 2' and third shoulder 20 of second panel 2 lie substantially in a horizontal plane. This gives a clapboard siding effect to the multiple panels installed on a structure. In this engaged position, fourth shoulder 24 and lower planar member 22 of second panel 2 abut and overlie first shoulder 12 and upper planar member 14, respectively, of first panel 2'. Overlie, when used here, refers to the overlap by a portion of a panel of another portion of a panel, which, therefore, protects that overlapped portion from exposure to the elements. Second panel 2 is then nailed to structure 19 along its nailing hem 4 and the process is repeated with a third panel 2" installed above second panel 2. The U-shaped projection 26 and second lip 28 of third panel 2" mate with the U-shaped channel 10 and first lip 8 of second panel 2 in a similar interlocking manner. This mating engagement ensures that vertically adjacent and overlapping panels are secured to one another in a positive manner. Such positive interlocking substantially prevents the separation of adjacent installed panels and, therefore, provides very high wind tolerances for such siding.

Figure 3:
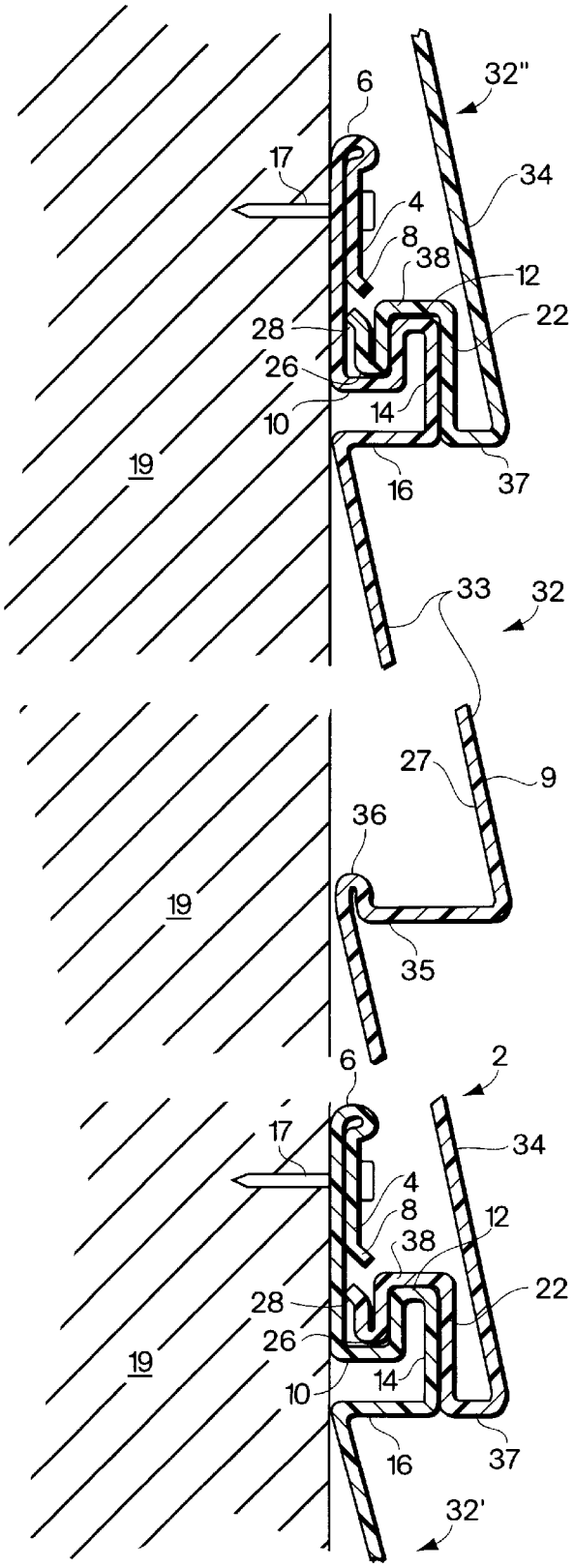
FIG. 3 is a schematic section view, shown partially cut away, of three vertically adjacent, overlapping, and interlocking siding panels of another embodiment of the present invention.

Another preferred embodiment of the present invention is shown in cross section in FIG. 3. Panel 32 has an upper declination 33 and a lower declination 34. Second shoulder 16 connects the lower edge of upper planar member 14 to an upper edge of upper declination 33. A third shoulder 35 connects a lower edge of upper declination 33 to an upper edge of lower declination 34. In a preferred embodiment, an upwardly projecting, substantially U-shaped projection 36 connects third shoulder 35 to the upper edge of lower declination 34. A fourth shoulder 37 connects a lower edge of lower declination 34 to the lower edge of lower planar member 22. A fifth shoulder 38 connects the upper edge of lower planar member 22 to U-shaped projection 26. In a preferred embodiment, first shoulder 12, second shoulder 16, third shoulder 35, fourth shoulder 37, and fifth shoulder 38 extend substantially horizontally. Panel 32 mates with and engages vertically adjacent panels 32', 32" in a manner similar to panel 2 as described above. Thus, second shoulder 16 of panel 32' and fourth shoulder 37 of panel 32 are substantially coplanar, that is, they lie substantially in the same plane. In a preferred embodiment, both second shoulder 16 of panel 32' and fourth shoulder 37 of panel 32 lie substantially in a horizontal plane. Horizontally extending third shoulder 35, as well as the coplanar alignment of second shoulder 16 with fourth shoulder 37, gives the installed siding a clapboard effect.

In another embodiment, panel 2 may comprise three or more declinations, each having a structure corresponding to the declinations of the embodiments shown in FIG. 3, with the uppermost declination connected at an upper edge thereof to the inner edge of second shoulder 16, the lowermost of the declinations being connected at a lower edge thereof to lower planar member 22 via a shoulder, and a plurality of intermediate shoulders, each intermediate shoulder connecting a lower edge of one of the declinations to an upper edge of one of the declinations.

Figure 4:
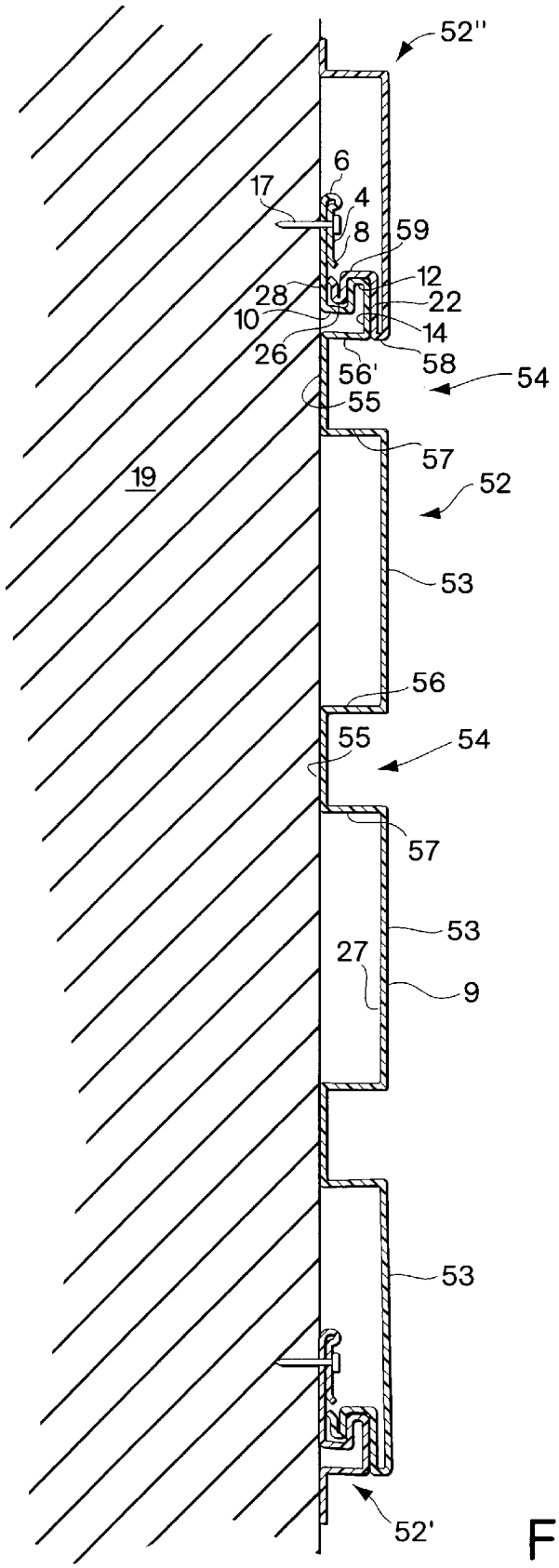
FIG. 4 is a schematic section view, shown partially cut away, of three vertically adjacent, overlapping, and interlocking siding panels of another embodiment of the present invention.

Another preferred embodiment of the present invention is shown in cross section in FIG. 4. It is to be appreciated that the siding panel depicted in this embodiment as illustrated is attached in a vertical plane to a substantially vertical surface. This particular embodiment can also be installed in a horizontal manner to a horizontally extending surface such as a soffit, or to a surface at any other desired angle. The use of the terms upper and lower with respect to this panel is, therefore, merely illustrative and not meant to limit the application of this embodiment to vertical installations. It is to be appreciated that all of the embodiments of the present invention may be installed on non-vertical surfaces as well.

Siding panel 52 has a plurality of intermediate planar members 53, each separated from adjacent intermediate planar members 53 by a longitudinal channel 54. Each channel 54 has a bottom wall 55, an upper side wall 56, and a lower side wall 57. Each upper side wall 56 is connected to a lower edge of an intermediate planar member 53, and each lower side wall 57 is connected to an upper edge of an intermediate planar member 53. An upper side wall 56' of a first uppermost channel 54 is connected to the lower edge of upper planar member 14. A second shoulder 58 connects a lower edge of a lowermost intermediate planar member 53 to the lower edge of lower planar member 22. A third shoulder 59 connects lower planar member 22 to U-shaped projection 26. In a preferred embodiment, second shoulder 58 and third shoulder 59 extend substantially horizontally. Panel 52 mates with and engages vertically adjacent panels 52', 52" in a manner similar to panel 2 as described above. Second shoulder 58 of panel 52" and upper side wall 56' of panel 52 are substantially coplanar, that is, they lie substantially in the same plane when the panels; are installed. In a preferred embodiment, second shoulder 58 and upper side wall 56' lie in a substantially horizontal plane. Third shoulder 59 and lower planar member 22 of panel 52" abut and overlie, respectively, first shoulder 12 and upper planar member 14 of panel 52.

Figure 5:
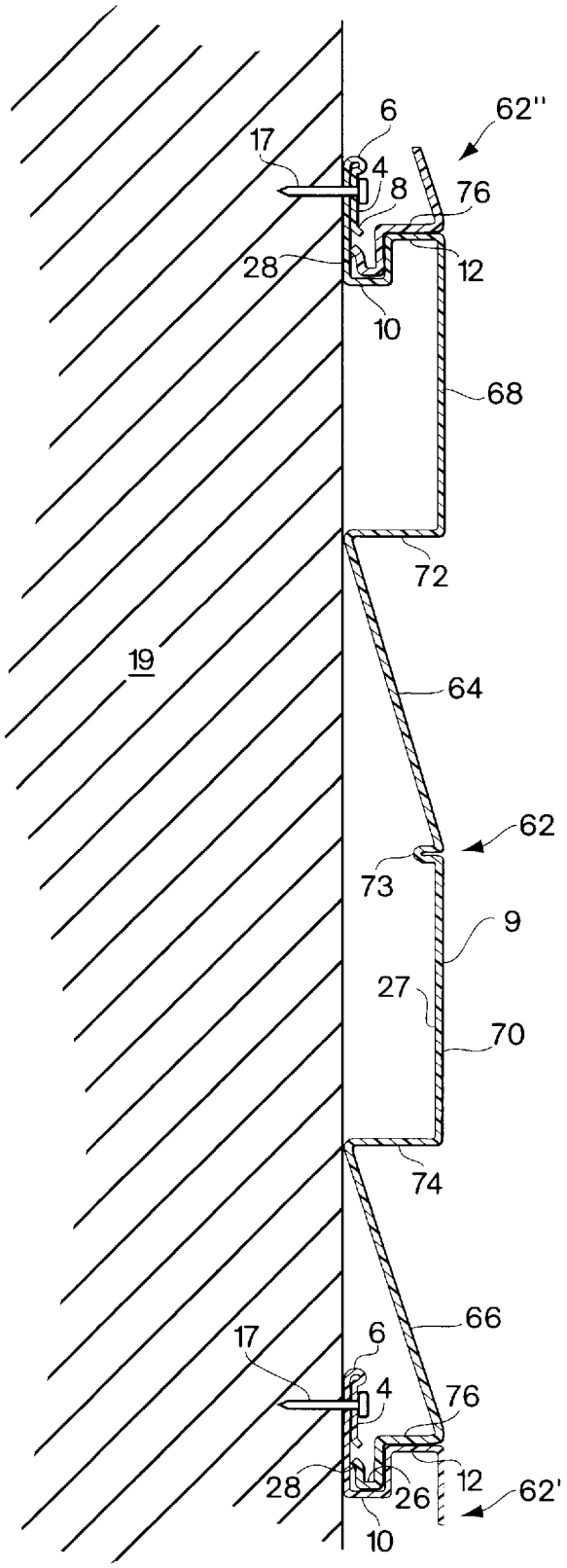
FIG. 5 is a schematic section view, shown partially cut away, of three vertically adjacent, overlapping, and interlocking siding panels of another embodiment of the present invention.

Another embodiment of the present invention is shown in cross section in FIG. 5. Panel 62 has an upper declination 64, a lower declination 66, an upper planar member 68, and a lower planar member 70. In a preferred embodiment, upper planar member 68 and lower planar member 70 are substantially coplanar and are substantially parallel to the surface of structure 19 to which panel 62 is attached. First shoulder 12 connects U-shaped channel 10 to an upper edge of upper planar member 68. A second shoulder 72 connects a lower edge of upper planar member 68 to an upper edge of upper planar member 64. A rib 73 extends along the back side of panel 2 and connects a lower edge of upper declination 64 to an upper edge of lower planar member 70. Rib, as used here, refers to a small projection extending along panel 2, preferably formed between and connecting upper declination 64 and lower planar member 70. A third shoulder 74 connects a lower edge of lower planar member 70 to an upper edge of lower declination 66. A fourth shoulder 76 connects a lower edge of lower declination 66 to U-shaped projection 26. In a preferred embodiment, first shoulder 12, second shoulder 72, third shoulder 74, and fourth shoulder 76 extend substantially horizontally. Panel 62 mates with and engages vertically adjacent panels 62', 62" in a manner similar to panel 2 as described above. Fourth shoulder 76 of panel 62 abuts and overlies first shoulder 12 of panel 62' when so installed.

In a preferred embodiment, the siding panels are manufactured in a post forming process. The first step in a post forming process is the extrusion of a flat sheet in a known extruding manner. The flat sheet is then shaped by calibration to form a desired profile. The extrusion of flat sheets has been found to be a more efficient and faster method than the prior art process of extruding a siding panel with profile tooling. The post forming process thereby can reduce costs, increase efficiency and increase yield in the manufacture of siding panels.

In a preferred embodiment, the panels are formed of one piece construction, that is, from one piece of material. Such construction provides for improved manufacturability, reduced costs, reduced complexity and improved handling. The panels may be formed of, for example, rigid polyvinyl chloride (PVC) or other suitable materials which will become readily apparent to those skilled in the art, given the benefit of this disclosure. In a preferred embodiment, the panels are formed of a sheet of PVC having a thickness of about 0.04 inches, and more preferably about 0.042 inches.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

I claim:

1. A siding panel adapted to be installed in an overlapping manner and in an interlocking relationship with other adjacent siding panels comprising, in combination:

a nailing hem folded back upon itself, forming a lateral edge of the siding panel, and terminating in a first lip projecting outwardly from a front side of the siding panel and away from the lateral edge;

a substantially U-shaped channel on the front side of the siding panel connected to the nailing hem, having a mouth facing the lateral edge;

a substantially U-shaped projection extending along the siding panel, the U-shaped projection being adapted to be received by a U-shaped channel of an adjacent siding panel; and a second lip connected to the U-shaped projection and projecting away from a back side of the siding panel and the U-shaped projection, adapted to engage and interlock with a first lip of an adjacent siding panel.

2. The siding panel according to claim 1, further comprising:

an upper planar member having an upper edge and a lower edge;

a first shoulder connected at an inner edge to the U-shaped channel and at an outer edge to the upper edge of the upper planar member;

a declination having an upper edge and a lower edge;

a second shoulder connected at an inner edge to the upper edge of the declination and at an outer edge to the lower edge of the upper planar member;

a lower planar member having an upper edge and a lower edge;

a third shoulder connected at an inner edge to the lower edge of the lower planar member and at an outer edge to the lower edge of the lower declination; and a fourth shoulder connected at an inner edge to the U-shaped projection and at an outer edge to the upper edge of the lower planar member.

3. The siding panel according to claim 2, wherein the siding panel is adapted to be installed on a substantially vertical surface, each of the first shoulder, the second shoulder the third shoulder, and the fourth shoulder extending substantially horizontally.

4. The siding panel according to claim 2, wherein the third shoulder is adapted to be substantially coplanar with the second shoulder of a vertically adjacent siding panel.

5. The siding panel according to claim 2, wherein the fourth shoulder and the lower planar member are adapted to abut and overlie the first shoulder and the upper planar member, respectively, of a vertically adjacent siding panel.

6. The siding panel according to claim 1, further comprising:

an upper planar member having an upper edge and a lower edge;

a first shoulder connected at an inner edge to the U-shaped channel and at an outer edge to the upper edge of the upper planar member;

an upper declination having an upper edge and a lower edge;

a second shoulder connected at an inner edge to the upper edge of the upper declination and at an outer edge to the lower edge of the upper planar member;

a lower declination having an upper edge and a lower edge;

a third shoulder connected at an inner edge to the upper edge of the lower declination and at an outer edge to the lower edge of the upper declination;

a lower planar member having an upper edge and a lower edge;

a fourth shoulder connected at an inner edge to the lower edge of the lower planar member and at an outer edge to the lower edge of the lower declination; and a fifth shoulder connected at an inner edge to the U-shaped projection and at an outer edge to the upper edge of the lower planar member.

7. The siding panel according to claim 6, wherein a projection extends along the siding panel and connects the inner edge of the third shoulder to the upper edge of the lower declination.

8. The siding panel according to claim 7, wherein the projection has a substantially inverted U-shape.

9. The siding panel according to claim 6, wherein the siding panel is adapted to be installed on a substantially vertical surface, each of the first shoulder, the second shoulder, the third shoulder, the fourth shoulder, and the fifth shoulder extending substantially horizontally.

10. The siding panel according to claim 9, wherein the upper planar member and the lower planar member extend substantially vertically.

11. The siding panel according to claim 6, wherein the fourth shoulder is adapted to be substantially coplanar with the second shoulder of a vertically adjacent siding panel.

12. The siding panel according to claim 6, wherein the fifth shoulder and the lower planar member are adapted to abut and overlie the first shoulder and the upper planar member, respectively, of a vertically adjacent siding panel.

13. The siding panel according to claim 1, further comprising:

an upper planar member having an upper edge and a lower edge;

a lower planar member having an upper edge and a lower edge;

a first shoulder connected at an inner edge to the U-shaped channel and at an outer edge to the upper edge of the upper planar member;

a plurality of declinations, each declination having an upper edge and a lower edge;

a second shoulder connected at an inner edge to the upper edge of an uppermost declination and at an outer edge to the lower edge of the upper planar member;

a plurality of intermediate shoulders, each shoulder connected at an inner edge to the upper edge of one of the declinations and at an outer edge to the lower edge of one of the declinations;

a fourth shoulder connected at an inner edge to the lower edge of the lower planar member and at an outer edge to the lower edge of the lowermost declination;

a fifth shoulder connected at an inner edge to the U-shaped projection and at an outer edge to the upper edge of the lower planar member.

14. The siding panel according to claim 1, further comprising:

an upper planar member having an upper edge and a lower edge;

a first shoulder connecting the U-shaped channel and the upper edge of the upper planar member;

at least one intermediate planar member, each intermediate planar member having an upper edge and a lower edge;

at least one longitudinal channel, each longitudinal channel having a bottom panel, an upper side wall and a lower side wall, each upper side wall being connected to the lower edge of an intermediate planar member, each lower side wall being connected to the upper edge of an intermediate planar member, the upper side wall of a first of the longitudinal channels being connected to the lower edge of the upper planar member;

a lower planar member having an upper edge and a lower edge;

a second shoulder connecting the lower edge of a first of the intermediate planar members and the lower edge of the lower planar member;

a third shoulder connecting the upper edge of the lower planar member and the U-shaped projection.

15. The siding panel according to claim 14, wherein the second shoulder is adapted to be substantially coplanar with the upper side wall of the first longitudinal channel of an adjacent siding panel.

16. The siding panel according to claim 14, wherein the third shoulder and the lower planar member are adapted to abut and overlie the first shoulder and the upper planar member, respectively, of an adjacent siding panel.

17. The siding panel according to claim 14, wherein each of the intermediate planar members lie substantially in a plane which is parallel to the plane of a surface of a structure to which the siding panel is secured.

18. The siding panel according to claim 14, wherein each of the bottom walls of the longitudinal channels is adapted to lie substantially in a plane which is parallel to the plane of a surface of a structure to which the siding panel is secured.

19. The siding panel according to claim 14, wherein each of the bottom walls of the longitudinal channels is adapted to abut and overlie a surface of a structure to which the siding panel is secured.

20. The siding panel according to claim 1, further comprising:

an upper planar member having an upper edge and a lower edge;

a first shoulder connected at an inner edge to the U-shaped channel and at an outer edge to the upper edge of the upper planar member;

an upper declination having an upper edge and a lower edge;

a second shoulder connected at an inner edge to the upper edge of the upper declination and at an outer edge to the lower edge of the upper planar member;

a lower planar member having an upper edge and a lower edge;

a rib extending along the back side of the siding panel and connecting the lower edge of the upper declination and the upper edge of the lower planar member;

a lower declination having an upper edge and a lower edge;

a third shoulder connected at an inner edge to the upper edge of the lower declination and at an outer edge to the lower edge of the lower planar member; and a fourth shoulder connected at an inner edge to the U-shaped projection and at an outer edge to the lower edge of the lower declination.

21. The siding panel according to claim 20, wherein the siding panel is adapted to be installed on a substantially vertical surface, each of the first shoulder, the second shoulder, the third shoulder, and the fourth shoulder extending substantially horizontally.

22. The siding panel according to claim 20, wherein the fourth shoulder is adapted to abut and overlie the first shoulder of an adjacent siding panel.

23. The siding panel according to claim 20, wherein the upper planar member and the lower planar member are adapted to lie substantially in a plane which is parallel to the plane of a surface of a structure to which the siding panel is secured.

24. The siding panel according to claim 1, wherein the siding panel is of one piece construction.

25. The siding panel according to claim 1, wherein the siding panel is formed of polyvinyl chloride.

26. A siding panel adapted to be installed in an overlapping manner and in an interlocking relationship with other adjacent siding panels comprising, in combination:

a nailing hem adjacent a lateral edge of the siding panel and terminating in a first lip projecting outwardly from a front side of the siding panel and away from the lateral edge;

a substantially U-shaped channel on the front side of the siding panel connected to the nailing hem, having a mouth facing the lateral edge;

a substantially U-shaped projection extending along the siding panel, the U-shaped projection being adapted to be received by a U-shaped channel of an adjacent siding panel; and a second lip connected to the U-shaped projection and projecting away from a back side of the siding panel and the U-shaped projection, adapted to engage and interlock with a first lip of an adjacent siding panel.

27. A siding panel adapted to be installed in an overlapping manner and in an interlocking relationship with other adjacent siding panels comprising, in combination:

a nailing hem adjacent a lateral edge of the siding panel and terminating in a first lip projecting outwardly from a front side of the siding panel and away from the lateral edge;

a substantially U-shaped channel on the front side of the siding panel connected to the nailing hem, having a mouth facing the lateral edge;

a substantially U-shaped projection extending along the siding panel, the U-shaped projection being adapted to be received by a U-shaped channel of an adjacent siding panel; and a second lip connected to the U-shaped projection and projecting away from a back side of the siding panel and the U-shaped projection, the second lip adapted to engage a first lip of an adjacent siding panel to substantially prevent the separation of the adjacent siding panels from one another.

* * * * *